US005483723A

United States Patent [19]

Wenzer

[11] Patent Number: 5,483,723

[45] Date of Patent: Jan. 16, 1996

[54] PAINT BRUSH WITH MODIFIED DOME SHAPED MEMBER

[76] Inventor: Kenneth C. Wenzer, 11538 February Cir. Apt. 402, Silver Spring, Md. 20904

[21] Appl. No.: 282,656

[22] Filed: Jul. 29, 1994

[51] Int. Cl.[6] ..... A46B 3/02

[52] U.S. Cl. ..... 15/193; 15/159.1; 15/204

[58] Field of Search ..... 15/159.1, 160, 15/171, 191.1, 192, 193, 204, 205, DIG. 4, 186, 168, 187

[56] References Cited

U.S. PATENT DOCUMENTS

| | | | |
|---|---|---|---|
| 430,877 | 6/1890 | Oram | 15/204 |
| 683,007 | 9/1901 | Walker | 15/204 |
| 1,009,082 | 11/1911 | McMillan | 15/204 |
| 1,031,584 | 7/1912 | Purdy | 15/204 |
| 1,105,573 | 7/1914 | McMillan | 15/204 |
| 2,230,126 | 1/1941 | Westervelt | 15/160 |
| 2,786,222 | 3/1957 | Rolker | 15/193 |
| 5,150,494 | 9/1992 | Wenzer | 15/193 |

FOREIGN PATENT DOCUMENTS

| | | | |
|---|---|---|---|
| 140475 | 3/1951 | Australia | 15/204 |
| 1532791 | 6/1970 | Germany | 15/193 |
| 582049 | 9/1958 | Italy | 15/193 |
| 706342 | 5/1966 | Italy | 15/193 |
| 424798 | 2/1935 | United Kingdom | 15/204 |

*Primary Examiner*—Mark Spisich
*Attorney, Agent, or Firm*—Robert Halper

[57] ABSTRACT

A paint brush having a plastic dome centrally located with respect to the sides and ends of the brush enclosed by a ferrule. Bristles are packed in a continuous channel defined by the space between the dome and the ferrule. After the bristles are inserted in the channel, the channel is filled with adhesive, Alternatively, the dome might be extended to the ends and sides of the ferrule, with the dome being subdivided into fingers and channels with bristles packed into the channels between the fingers.

6 Claims, 2 Drawing Sheets

PAINT BRUSH WITH MODIFIED DOME SHAPED MEMBER

BACKGROUND OF THE INVENTION

This invention pertains to paint brushes and is an improvement over my U.S. Pat. No. 5,150,494 which was designed to employ a dome shaped member for preventing paint from collecting in the ferrule. All the discussion therein is incorporated in this application by reference. The dome was a hard plastic member which prevented paint from settling at the base of the bristles after a painting operation. By interposing a dome between the lower ends of the bristles and the ferrule, paint would then settle on the dome more or less as an arc and the same could easily be cleaned or removed by use of a wire implement.

While this brush has been favorably received by the industry, manufacturers have been reluctant to use it because of the high cost involved to make a tool that would penetrate the plastic with sufficient perforations and at the same time to load the perforations with the plurality of fine bristles, In view of this situation and because of a great interest elicited in the dome concept, it was decided that a simpler procedure was required that could achieve the benefits of the dome by changing its arrangement that would enable easier implantation of the bristles.

DESCRIPTION OF THE PRIOR ART

A search of the patent files did not reveal any further use of domes than that disclosed in my prior patent, but there were a number of patents that did organize bristles other than mounting them solely with a binder.

U.S. Pat. No. 33,070 is an early design of a brush showing a frame A and purality of space parallel frame bars extending transversely of the frame, each frame bar having a plurality of bristles along the length of the bar.

U.S. Pat. No. 1,924,152 shows a tooth brush having a series of spaced parallel rows of bristles. Each row of bristles C is convexly shaped and their ends bordered by rubber bristles 4. The bristles appear to be mounted in the floor of the base.

U.S. Pat. No. 2,781,739 is an animal hair groomer wherein a plurality of parallel spaced comb elements 12, 13, 14, 15 are arranged longitudinally and are placed in longitudinal slits 18 located in a hinged plate 17. The plate rests on a base 10 and the combs are held in place by screws 16.

U.S. Pat. No. 2,789,298 shows a scrubbing brush where a flat solid sheet has downturned edges 2, 3 at the ends. A rubber strip 4 encircles the backing. A plurality of steel channels 5 in slightly spaced side by side relationship are welded together as at 6. Each channel holds a plurality of a length of brush strip 7.

U.S. Pat. No. 2,790,986 is a paint brush that comprises a back and a plurality of knots of fine guage filament material which converge toward each other. The brush back 12 comprises a solid elongated body 14 having inner face 15 and outer face 16 and rounded ends 17, 18. The outer face is formed with the plurality of transverse rows of cylindrical sockets or inwardly extending openings. Centrally located are a pair of transversely spaced openings 20, 21. Outwardly thereof are openings 24, 25, 28, 29. The openings terminate with end walls 22, 23, 26, 27. Other than the centrally located openings, the others are at a slight inclination. A knot 50 of bristles of various lengths and desired proportions are placed in the openings, and the knot is crimped to give the bristles a zig zag shape. The filaments can be made from polystyrene, etc. A staple 51 has its bight receiving the mid-portion of the knot with its legs 30 extending through the wall 30 and brush back 14. After stapling the knot is further waterproofed and secured with glue. The glue overflows and comes to the outer surface.

Swiss Patent 139,144 shows a metallic brush body which serves to improve fastening of the brush ends in the plate of the body. In the metal plate ringlike supports f are expressed. Brushes e are fastened in metal shells c within the supports. The shells are closed at one end and at the other surrounded by a ring flange d. The arrangement is such that it is almost impossible for the brushes to loosen. The shells lie in openings b of the supports so that the flange overlies the metal plate. The supports are arranged in precise rows behind one another, To secure the brush setting c, in the plate there are arranged loops between the rows and both ends. The loops are pressed out from a piece of the plate and are of such height that they extend over the ring flange. Rods are placed in the loop which are of such a breadth that they cover the flange.

As shown by the prior art the use of transverse and longitudinal channels for inserting bristles in brush frames, including paint brushes is old; however, none of the prior art concerns itself with a domed brush, nor does the purpose of the channels bear any relationship with the domed paint brush of this invention.

Therefore the first object of this invention is to simplify the securement of bristles in a paint brush having a dome.

It is also an object of this invention to pack the bristles in a continuous channel between a ferrule and a centrally located dome.

It is a further object of this invention to divide the centrally located dome into a plurality of segments separated by channels in which the bristles can be packed.

It is still an object of this invention to maintain the inventive concept of forming a dome so as to facilitate cleaning of the brush and prevent paint from lodging in the bristles.

SUMMARY OF THE INVENTION

As stated above this invention represents an improvement over my prior patent U.S. Pat. No. 5,150,494 in that several new ways have been discovered to load the dome with bristles without perforating the dome. One basic concept is to place the dome in the center of a ferrule with respect to the ends and sides thereof with the bristles placed continuously around the dome in a channel between the dome and the ferrule. Additionally the dome itself can have grooves around its periphery and the grooves packed with additional bristles. The dome might have an integral unit in the form of a tortoise shaped convex surface that tapers toward the ends of the ferrule with a rectangular shim as a lower extension. Alternatively and somewhat like the aforementioned patents that use channels to hold bristles, the second basic concept divides a dome per se into a plurality of spaced segments each arranged progressively to maintain the integrity of the dome. In this situation the dome is of the type shown in my earlier U.S. Pat. No. 5,150,494, wherein the dome extends completely between the ends and sides of the ferrule. The channels can be arranged in various ways, such as transversely or longitudinally as viewed from the front of the brush. The material of the dome as in my earlier patent is made of a hard, machinable plastic material.

DETAILED DESCRIPTION OF THE INVENTION

Figure 1:
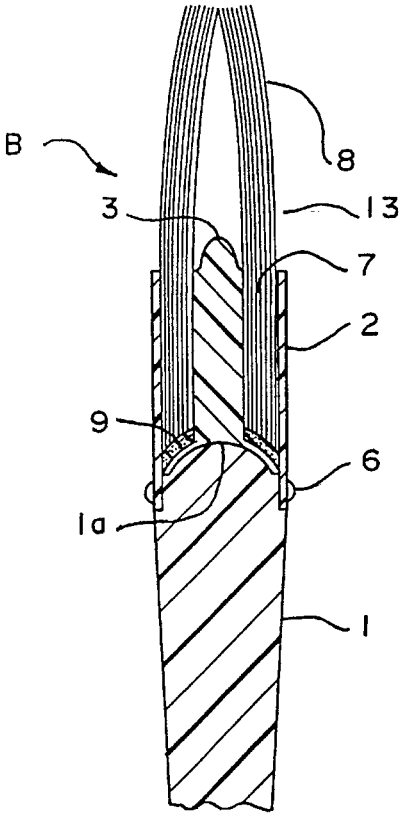
FIG. 1 is a sectional view of a paint brush taken on line 1—1 of FIG. 2 showing a dome structure placed centrally of the brush with respect to the ends and sides of a ferrule.
Figure 2:
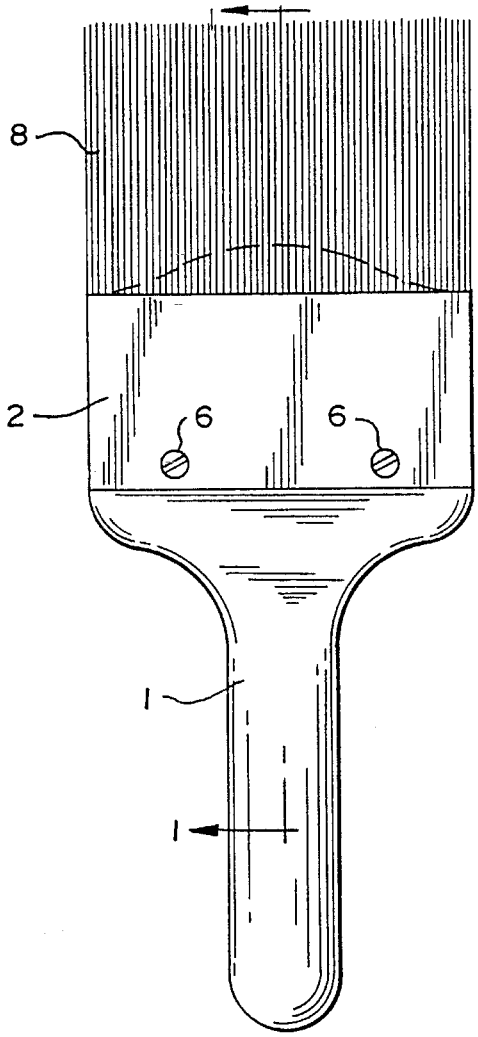
FIG. 2 is a frontal view of the paint brush of FIG. 1.
Figure 3:
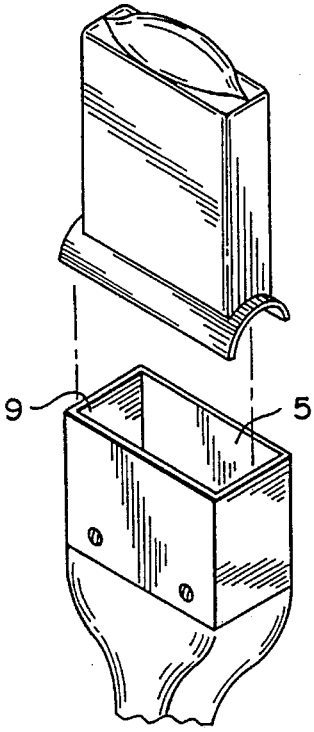
FIG. 3 is a perspective view of the dome of FIG. 1 showing the frerrule and the channel therein.
Figure 4:
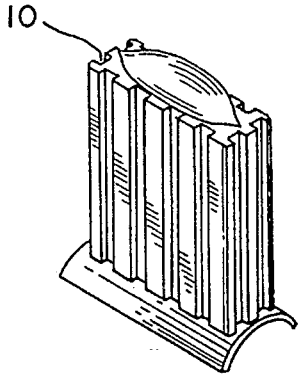
FIG. 4 is a perspective view of the dome of FIG. 1 showing an embodiment wherein the periphery of the dome has been grooved.
Figure 5:
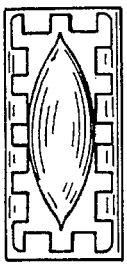
FIG. 5 is a plan view of FIG. 4.
Figure 6:
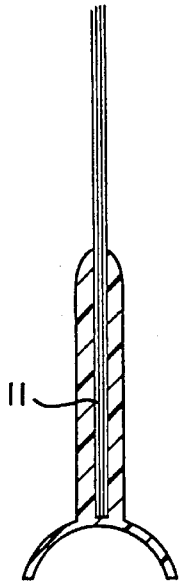
FIG. 6 is a sectional view showing an embodiment wherein the dome structure of FIG. 1 has a channel placed therein.
Figure 10:
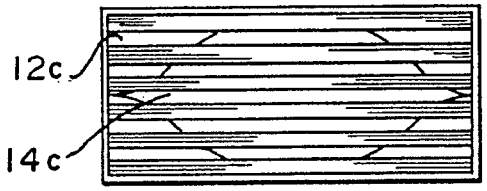
FIG. 10 shows a plan view of an embodiment wherein the dome is subdivided so that the channels and dome pieces are of equal length and run longitudinally.
Figure 9:
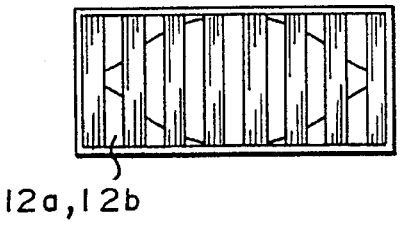
FIG. 9 shows a plan view of respective FIGS. 7 and 8.
Figure 7:
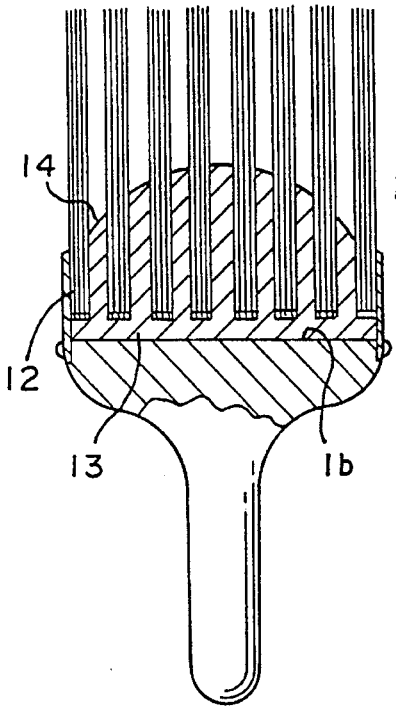
FIG. 7 is a front sectional view of a paint brush showing the dome subdivided with channels extending transversely across the dome that extends to both the ends and sides of the ferrule.
Figure 8:
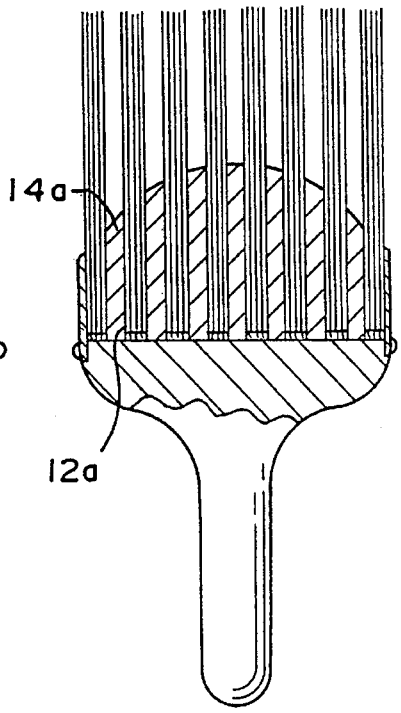
FIG. 8 is a front sectional view showing another embodiment wherein the subdivided dome is made up of independent pieces.

FIG. 1 shows a sectional view of a paint brush B having a conventional wooden handle 1 with a curved end portion 1*a*, ferrule 2 and a plastic dome 3 that, as seen from above has a tortoise shape which tapers towards the ends of the ferrule and is integral with a rectangular shim 4 and a convex base 5 that extends to the ends and sides of the ferrule and abuts the curved end portion of the handle. The ferrule extends downwardly over a small portion of the wooden handle and is secured thereto by a pair of spaced screws 6 on each side. The shim extends upwardly from the base to the top edge of the ferrule. Both shim and dome that projects above the shim are centrally located with respect to the ends and sides of the ferrule and are spaced therefrom to form a channel 7. This channel is filled with bristles 8 whose lower ends are adhesively held in the channel and to the base by a binder 9 which may be an epoxy resin composition which extends to the top edge of the ferrule and the shim. The effect of this arrangement is to cause the bristles to diverge in the region of the shim and dome and then come together again beyond the top of the dome. Accordingly just above the dome and before the bristles completely converge there is a small triangular cavity. Therefore during a painting operation most of the paint will fall in this area where the bristles converge, then down through the cavity and settle on the dome in conformance with its contoured surface, from which it can easily be removed by passing a wire implement transversely across the dome. To compensate for the fact that some paint will settle on the sides and the ends between the dome and the ferrule, an implement such as a wire brush that is generally used to scrape the paint that settles on the dome can be inclined at an angle defined by the top surface of the dome and the top edge of the ferrule so that most of the paint that settles in this area can also be removed. In FIG. 4 there is shown an embodiment wherein the dome and its accompanying shim have grooves 10 around its periphery so as to accommodate more bristles which are packed into these grooves and sealed with binder in the same manner as described above. As shown in FIG. 6, in addition to packing bristles in channels between the dome and the ferrule or using grooves around the periphery of the dome, a single rectangular channel 11 that passes through the center of the dome to the base might be formed and packed with bristles and sealed with binder. FIG. 7 shows an embodiment using a dome of the type shown in U.S. Pat. No. 5,150,494 wherein the dome extends to the sides and ends of the ferrule, the difference being in that the dome is divided into a plurality of channels 12, and includes an integral flat base 13 which abuts a flat rectangular end portion 1*b* of a wooden handle. Starting from both sides, the dome is divided into a plurality of fingers 14 integral with the flat base and separated by the aforesaid channels 12, each finger becoming progressively higher until the finger which straddles the center is reached. This finger represents the highest point. Each finger has a slight slope of about 4 to 6 degrees in the direction of the finger that straddles the center so as to preserve the contour of a dome. Each channel is filled with a plurality of bristles which are adhesively held in place by binder to the height of each finger So that there are no gaps between the bundles of bristles and the fingers. FIG. 8 shows a variation of arranging the fingers 14*a* as independent fingers wherein the channels 12*a* are open and the butt ends of the fingers are bonded to the base located in the ferrule. In FIG. 10 there is shown an embodiment wherein channels 12*b* and fingers 14*b* extend longitudinally through the dome. Except for the fact that the fingers and channels are arranged longitudinally, the construction is similar to FIG. 7, wherein the fingers are integral with the base. The bristles are packed in the channels with binder to the tops of their respective channels. The plastic used for the dome including the integral base may be any machineable hard plastic such as ABS (acrylonitrile butadiene resin), a polycarbonate, or a plastic sold under the trademark Teflon, etc. The invention as described above provides an economical method of using a dome so as to prevent paint from collecting at the base of the bristles in the ferrule.

The foregoing detailed description of the various embodiments of this invention clearly demonstrates the advantages and improvements over my prior patent. The present invention should not be considered as restricted to that described above and shown in the drawings, as many modifications could be made without departing from the spirit and scope of the invention.

I claim:

1. A paint brush which is configured so as to facilitate cleaning thereof, said brush comprising a handle having a first wide end portion and a second narrow portion medial of said first wide end portion and descending downwardly therefrom; said first wide end portion having a top surface; an annular metal ferrule secured to said first wide end portion of said handle; said annular ferrule having an inner surface, a top edge and extending completely around the periphery of the first wide end portion of said brush; a dome shaped hard plastic member that includes an upper surface, a lower surface and a base at said lower surface both of which are integral with said upper surface; said base abutting said top surface of said first wide end portion of said handle and which is adhesively bonded thereto and extending to the inner surface of the ferrule; said plastic dome being positioned in a center of said brush within a space defined by said ferrule; a continuous channel between said inner surface of said ferrule and said dome; a plurality of bristles having lower ends that extend to said base and around said upper surface and said lower surface integral with said dome; said lower ends of said bristles being adhesively bonded within said channel to said base and said lower dome surface; said lower surface extending from the base to said top edge of said ferrule; said adhesive being added to said top edge; said dome including said upper surface extending and devolving to an apex above the top edge of said ferrule and then tapering towards said inner surface of said ferrule; said dome forming a convex barrier between said bristles in said channel and adjacent said dome, whereby a substantial portion of paint collected during painting settles on said dome shaped member, thereby facilitating its removal.

2. A paint brush as in claim 1 wherein said base is convexly shaped and said lower surface of the dome is in the form of a rectangular shim.

3. A paint brush as in claim 1 wherein the periphery of said dome has a plurality of spaced grooves in which are packed bristles adhesively bonded thereto.

4. A paint brush as in claim 1 wherein said dome has at least one channel that extends from the upper surface of the dome to said base which is adhesively packed with bristles.

5. A paint brush as in claim 1 wherein said plastic dome is one of several plastics selected from the group consisting of polyethylene, ABS resin, polycarbonate and polytetrafluoroethylene and the adhesive is an epoxy resin.

6. A paint brush as in claim 1 wherein said dome has a plurality of bristles mounted on and extending from the upper surface thereof.

* * * * *